US008928439B2

(12) United States Patent
Stitz

(10) Patent No.: US 8,928,439 B2
(45) Date of Patent: Jan. 6, 2015

(54) POLE TUBE AND ACTUATION MAGNET HAVING SUCH A POLE TUBE

(75) Inventor: Matthias Stitz, Lohr am Main (DE)

(73) Assignee: Robert Bosch GmbH, Stuttgart (DE)

( * ) Notice: Subject to any disclaimer, the term of this patent is extended or adjusted under 35 U.S.C. 154(b) by 1146 days.

(21) Appl. No.: 12/147,777

(22) Filed: Jun. 27, 2008

(65) Prior Publication Data

US 2009/0002109 A1 Jan. 1, 2009

(30) Foreign Application Priority Data

Jun. 27, 2007 (DE) ..... 10 2007 029 807

(51) Int. Cl.
*H01F 3/00* (2006.01)
*H01F 7/08* (2006.01)
*H01F 7/16* (2006.01)

(52) U.S. Cl.
CPC ..... *H01F 7/081* (2013.01); *H01F 7/1607* (2013.01); *H01F 2007/085* (2013.01)
USPC ..... 335/281

(58) Field of Classification Search
USPC ..... 335/281; 251/129.15
See application file for complete search history.

(56) References Cited

U.S. PATENT DOCUMENTS 3,460,081 A * 8/1969 Tillman ..... 335/234
4,809,749 A * 3/1989 Ichihashi ..... 137/625.65
5,050,840 A * 9/1991 Kondo et al. ..... 251/129.15
5,467,962 A * 11/1995 Bircann et al. ..... 251/129.15
5,509,439 A * 4/1996 Tantardini ..... 137/269
5,687,698 A * 11/1997 Mastro et al. ..... 123/568.26
5,878,779 A * 3/1999 Bircann et al. ..... 137/554
6,390,078 B1 * 5/2002 Gee et al. ..... 123/568.2
6,422,223 B2 * 7/2002 Meilinger et al. ..... 123/568.21
6,453,934 B1 * 9/2002 Bircann et al. ..... 137/242
6,498,416 B1 * 12/2002 Oishi et al. ..... 310/214
6,564,443 B2 * 5/2003 Oishi et al. ..... 29/596
6,628,186 B1 * 9/2003 Wolfges ..... 335/220
6,759,934 B2 * 7/2004 Bircann et al. ..... 335/255
6,860,467 B2 * 3/2005 Yamamoto et al. ..... 251/129.15
6,864,771 B2 * 3/2005 Komiyama et al. ..... 335/220
6,877,717 B2 * 4/2005 Collins et al. ..... 251/129.15
7,468,647 B2 * 12/2008 Ishibashi et al. ..... 335/281
7,581,302 B2 * 9/2009 Tyler ..... 29/557
7,735,803 B2 * 6/2010 Junker et al. ..... 251/129.15
2004/0056227 A1 * 3/2004 Mayr et al. ..... 251/129.15

OTHER PUBLICATIONS

Klaus-Dieter Linsmeier, "Die Bibliothek der Technik" [Library of Technology], vol. 118, published by Verlag Moderne Industrie, 1995, Germany.

* cited by examiner

*Primary Examiner* — Alexander Talpalatski
(74) *Attorney, Agent, or Firm* — Maginot, Moore & Beck LLP

(57) ABSTRACT

A pole tube including a non-magnetic spacer ring configured to join a pole piece along a control cone and also configured to join a tube piece along a back annular surface. The annular surface includes a first face section and a second face section. The first face section and the second face section are disposed at an angle with respect to each other.

14 Claims, 3 Drawing Sheets

POLE TUBE AND ACTUATION MAGNET HAVING SUCH A POLE TUBE

CROSS REFERENCE TO PRIOR APPLICATIONS

Priority is claimed to German Patent Application No. DE 10 2007 029 807.4, filed Jun. 27, 2007. The entire disclosure of this application is incorporated by reference herein.

The present invention relates to a pole tube for an actuation magnet and to an actuation magnet configured with such a pole tube.

BACKGROUND

A pole tube and an actuation magnet are described in the publication titled "Die Bibliothek der Technik" [Library of Technology], volume 118; authored by Klaus-Dieter Linsmeier, published by Verlag Moderne Industrie, 1995, incorporated by reference herein. According to this publication, a pole tube of an actuation magnet has a pole piece on the front face that is connected to a tube piece or yoke via a spacer ring made of non-magnetic material. An armature is movably mounted inside the pole tube and the final stroke position (operating stroke) of this armature is defined when it makes contact with a front face of the pole piece or with a non-stick platelet attached thereto. In the transition area between the spacer ring and the pole piece, a so-called control cone is formed that widens in the direction of the stroke. The geometry of this control cone is selected in such a way that the characteristic curve of the proportional magnet runs essentially linearly. Such electromagnets are employed, for example, to actuate the valve stems or pistons of hydraulic valves and, depending on the application case and on the way the valve is triggered, the interior of the pole tube can be charged with a very high pressure. The pole tube can fail owing to the high internal pressure and the resulting high mechanical loads, so that damage such as, for instance, crack formation, can occur, especially in the transition area from the spacer ring to the tube piece.

SUMMARY OF THE INVENTION

An aspect of the present invention is to provide a pole tube and an actuation magnet with which the pressure-tightness may be improved.

BRIEF DESCRIPTION OF THE DRAWINGS

A preferred embodiment of the invention will be explained in greater detail below making reference to schematic drawings. The following is shown.

DETAILED DESCRIPTION

According to the present invention, the transition area between the spacer ring and the tube piece is not configured as is normally done with a continuous slanted surface (see the above-mentioned state of the art), but rather, with two front face sections set at an angle with respect to each other, so that the support between these two components may be improved in the axial and radial directions and the rigidity of the tube is correspondingly enhanced, as a result of which the operating reliability of the pole tube may be improved in comparison to conventional solutions.

In an embodiment of the present invention, a surface section located radially on the outside is arranged slanted relative to the axis of the pole tube in the transition area between the spacer ring and the tube piece. This conical surface section located radially on the outside then adjoins a cylindrical section located radially on the inside or a section having a more acute angle of taper, so that the rigidity is further optimized.

According to one aspect of the invention, it is preferred for this spacer ring to be manufactured by means of build-up welding.

The spacer ring is particularly easy to manufacture if it is configured symmetrically relative to a radial plane.

In a preferred embodiment of the present invention, the radial extension of the surface section located on the inside is considerably smaller than the radial extension of the conical surface section located radially on the outside or than the wall thickness of the pole tube in this area.

Figure 1:
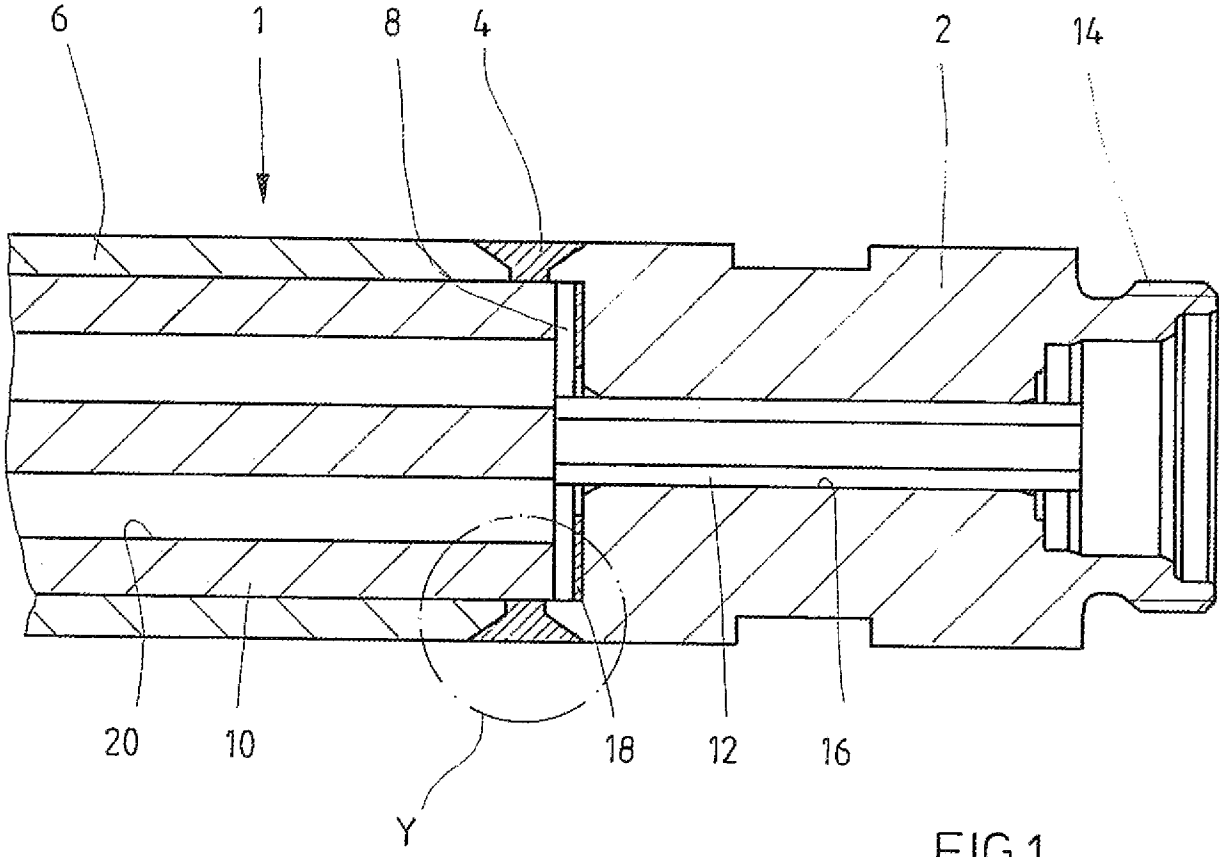
FIG. 1—a simplified longitudinal section through a proportionally adjustable actuation magnet of a valve, FIG. 2—a detailed depiction of the actuation magnet from FIGS. 1 and FIG. 3—an exploded detailed depiction of the actuation magnet from FIG. 1.

FIG. 1 shows part of a longitudinal section through a pole tube 1 of a proportionally adjustable actuation magnet with a pressure-tight construction. The pole tube 1 consists essentially of a pole piece 2, a spacer ring 4 and a tube piece 6. In the solution presented here, the spacer ring 4 has been manufactured by means of build-up welding. In principle, however, this spacer ring 4 can also be prefabricated as a separate component and then joined to the pole piece 2 and to the tube piece 6, for instance, by means of thermal joining. Together, these three components form an armature space 8 in which an armature 10 is arranged with an air gap so as to be axially movably. A tappet 12 that passes through the pole piece 2 in the axial direction and that is directly or indirectly connected to a control stem of a valve for purposes of actuating the latter is affixed to the armature 10. It is also possible for the tappet 12 to be configured as a separate component so that the armature 10 strikes against the tappet 12.

In the end section shown on the right-hand side of FIG. 1, the pole tube 2 has a central thread 14 by means of which it can be screwed into a valve hole of a valve housing, so that the tappet 12 is in operative connection with the control stem of the valve. The tappet 12—which in the embodiment shown is configured with a hexagonal cross section so that it is secured against turning—passes through a through hole 16 of the pole piece 2 which, on the one hand, widens stepwise in the area of the central thread and, on the other hand, opens into the armature space 8. A non-stick platelet 18 is placed onto the front face of the pole piece 2 that limits the armature space 8 towards the right (view in FIG. 1), said non-stick platelet 18 preventing magnetic adhesion of the armature 10 in its final stroke area and limiting the latter for purposes of linearizing the characteristic curve. The pole tube 2 can also be configured without the non-stick platelet 18. In such a case, however, the grooved recess shown in FIG. 2 should be provided in the transition area between the circumferential wall and the front wall of the armature space 8.

The spacer ring 4 consists of a non-magnetizable material, for example, austenitic steel, brass or bronze. The pole piece 2 and the tube piece 6, in contrast, are made of a magnetizable material, for instance, conventional machining steel.

The armature 10 is configured with longitudinal holes 20, so that the armature 10 is pressure-equalized on its front face. A relatively high pressure that is defined by the system pressure that is to be controlled by the valve prevails in the armature space 8.

For the sake of simplicity, reference is hereby made to the above-mentioned state of the art when it comes to the description of additional details of a proportionally adjustable actuation magnet.

Figure 2:
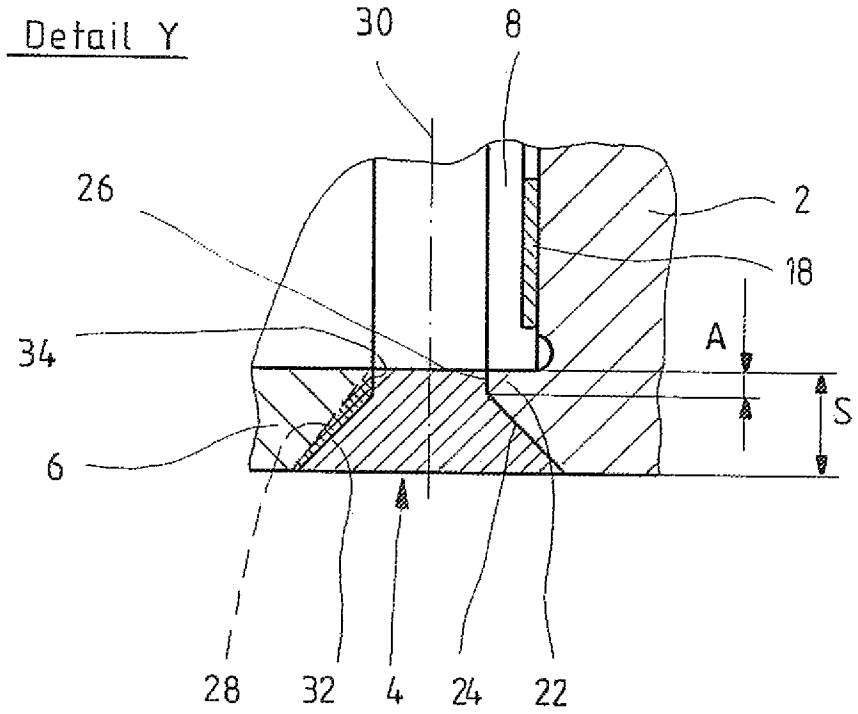
Figure 3:
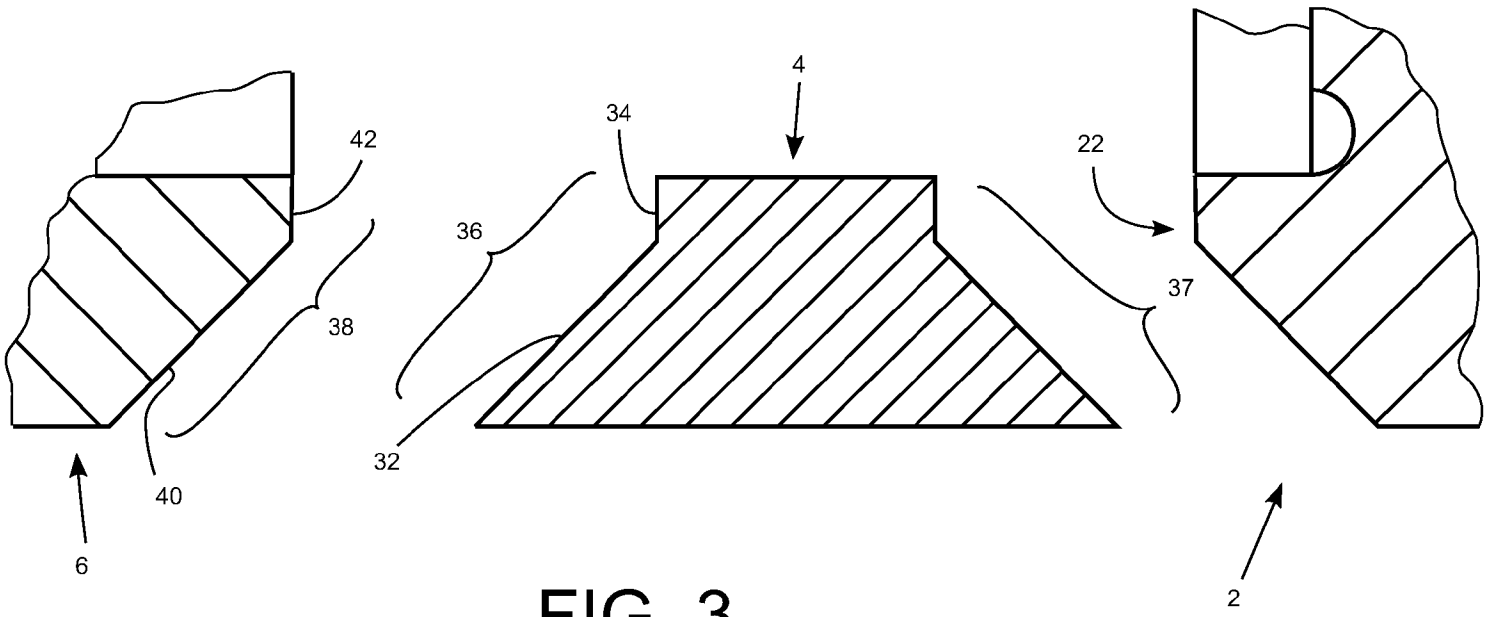

The structure of the spacer ring 4 is explained with reference to the detailed depiction in FIGS. 2 and 3. This figure shows the detail Y in FIG. 1, whereby the armature 10 and the tappet 12 have been left out for the sake of clarity. It can be seen in this enlarged depiction that a control cone 22 is formed on the annular front face of the pole piece 2 facing the spacer ring 4, said control cone 22 tapering opposite to the direction of the stroke. This control cone 22 is normally configured as a truncated conical ring having a conical surface 24 which adjoins a radial front face 26 that lies in a radial plane, The radial extension A of the radial front face 26 is smaller than the wall thickness S of the part of the pole tube 1 that limits the armature space 8. In the embodiment shown, the A-to-S ratio is less than 2:3.

The spacer ring 4—whose geometry is formed on the front face that faces the pole piece 2 to be matching—which is produced by means of build-up welding, is placed onto this control cone 22 of the pole piece 2. Typically with pole tubes known in the art the connection area or the boundary surface between the spacer ring 4 and the tube piece 6—as shown in FIG. 2 by the broken line—is configured as a slanted surface 28 that extends continuously along the wall of the tube piece 6. The invention diverges from this conventional geometry, and the area of the spacer ring 4 on the side of the tube piece is configured with two stir ace sections 32, 34 set at an angle with respect to each other. In the embodiment shown, the left-hand first from face 36 of the spacer ring 4 is configured analogously to the geometry of the control cone 22, so that the first front face 36 and second front face 37, on the right hand side of FIGS. 2 and 3, are symmetrical to a radial plane 30 of the spacer ring 4.

Accordingly, the first front face 36 of the spacer ring 4 on the side of the tube piece and the corresponding surface 38 of the tube piece 6 are configured in sections, such that the spacer ring includes a first surface section 32 that is conical and extends in the radial direction towards the outside. A radial second surface section 34 adjoins this conical first surface section 32 radially towards the inside, so that the spacer ring 4 has a cylindrical circumferential section located radially on the inside and a conical annular section located on the outside that widens radially towards the outside. The adjacent front face 38 of the tube piece 6 is configured correspondingly with a first surface section 40 corresponding to conical first surface section 32 of the spacer and a second surface section 42 corresponding to radial second surface section 34 of the spacer. Owing to this connection of the tube piece 6 to the spacer ring 4 and owing to the ensuing support in the radial and axial directions, the rigidity of the pole tube in the radial and axial directions is considerably improved, so that when the pole tube is exposed to a continuous load, it is anticipated that it will only fail at considerably higher internal pressures when compared to the conventional solutions, Naturally, the geometry of the front face of the spacer ring 4 on the tube side is not restricted to the symmetrical configuration according to FIG. 2; in principle, the setting angle of the surface sections 32 and 34 can also be chosen differently from that of the embodiment described above. It is also possible to provide more than two surface sections set at an angle with respect to each other in order to enhance the rigidity, in other words, the front face on the tube side can be selected with an eye towards achieving the maximum rigidity and pressure resistance, while the front face of the spacer ring 4 on the tube side is dimensioned with an eye towards optimizing the force-stroke characteristic curve of the actuation magnet.

The present invention can also be employed for conventional switching magnets or solenoid actuators.

A pole tube and an actuation magnet with such a pole tube are disclosed. The pole tube has a spacer ring which, on the one hand, is joined to a pole piece along a control cone and, on the other hand, is joined to a tube piece along a back surface. According to the present invention, the boundary surface on the back is provided between the spacer ring and the tube piece with two front face sections set at an angle with respect to each other.

The invention claimed is:

1. A solid pole tube comprising:

a pole piece including a control cone including a conical surface and a radial front face;

a tube piece having a front face defining a first surface section and a second surface section; and a solid non-magnetic spacer ring joining the pole piece along the control cone and joining the tube piece along the front face, wherein the first surface section and the second surface section are disposed at an angle with respect to each other.

2. The pole tube as recited claim 1, wherein the first surface section is a conical section and wherein the second surface section is a cylindrical section.

3. The pole tube as recited in claim 1, wherein the tube piece defines a pole tube axis, wherein the first surface section is disposed at a radially outer side of the spacer ring and at a slant with respect to the pole tube axis, wherein the second surface section is disposed at a radially inward side of the spacer ring.

4. The pole tube as recited in claim 1, wherein the spacer ring is manufactured using build-up welding.

5. The pole tube as recited in claim 1, wherein the control cone and the front face are symmetrical with respect to a radial plane.

6. The pole tube as recited in claim 1, wherein the second surface section has a radial extension less than ⅔rds of a wall thickness of the spacer ring.

7. An actuation magnet comprising:

a solid pole tube including a pole piece having a control cone with a conical surface and a radial front face, a tube piece having a front face defining a first surface section and a second surface section, and a solid non-magnetic spacer ring joining the pole piece along the control cone and joining the tube piece along the front face; and an armature configured to be axially movable, wherein the first surface section of the tube piece and the second surface section of the tube piece are disposed at an angle with respect to each other.

8. The actuation magnet as recited in claim 7, wherein the first surface section is a conical section and wherein the second surface section is a cylindrical section.

9. The actuation magnet as recited in claim 7, wherein the first surface section and the second surface section are symmetrical with respect to a ring radial plane.

10. The actuation magnet as recited in claim 7, wherein the first surface section is disposed radially inward as compared to the second surface section.

11. A solid spacer ring for connecting a pole piece and a tube piece of a pole tube, comprising:

a first front face facing the tube piece and having a first surface section and a second surface section;

a second front face facing the pole piece, the first front face and the second front face being symmetrical with respect to a ring radial plane; and wherein the spacer ring includes a solid non-magnetic material and the first surface section and the second surface section are disposed at an angle with respect to each other.

12. The spacer ring as recited in claim 11, wherein the first surface section is a conical section and wherein the second surface section is a cylindrical section.

13. The spacer ring as recited in claim 11, wherein the first surface section is disposed radially inward as compared to the second surface section.

14. The spacer ring as recited in claim 11, wherein the spacer ring is prefabricated and configured to be joinable to a pole piece and a tube piece.

* * * * *